US009746800B2

(12) United States Patent
Koike

(10) Patent No.: US 9,746,800 B2
(45) Date of Patent: Aug. 29, 2017

(54) LIQUID STORING BODY INCLUDING A STIRRING MEMBER

(71) Applicant: Seiko Epson Corporation, Tokyo (JP)

(72) Inventor: Yasunori Koike, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/060,802

(22) Filed: Mar. 4, 2016

(65) Prior Publication Data

US 2016/0259268 A1 Sep. 8, 2016

(30) Foreign Application Priority Data

Mar. 5, 2015 (JP) ..... 2015-043266

(51) Int. Cl.
*G03G 15/08* (2006.01)
*B41J 2/175* (2006.01)

(52) U.S. Cl.
CPC ..... *G03G 15/0889* (2013.01); *B41J 2/175* (2013.01)

(58) Field of Classification Search
CPC ..... G03G 15/0889; B41J 2/174; B41J 2/175; B41J 29/38
See application file for complete search history.

(56) References Cited

U.S. PATENT DOCUMENTS

| | | | |
|---|---|---|---|
| 2010/0103233 | A1 | 4/2010 | Akatsuka et al. |
| 2011/0128329 | A1 | 6/2011 | Yoshino et al. |
| 2011/0310141 | A1 | 12/2011 | Takahashi et al. |
| 2012/0081421 | A1 | 4/2012 | Kondo |

FOREIGN PATENT DOCUMENTS

| | | | | |
|---|---|---|---|---|
| EP | 0736388 | A2 | | 10/1996 |
| EP | 2511098 | A1 | | 10/2012 |
| EP | 2657027 | A1 | | 10/2013 |
| JP | 2005-066520 | A | | 3/2005 |
| JP | 2005066520 | A | * | 3/2005 |
| JP | 2010-184424 | A | | 8/2010 |
| JP | 2012-076422 | A | | 4/2012 |
| WO | WO-2009-156755 | A1 | | 12/2009 |

OTHER PUBLICATIONS

Extended European Search Report for EP Application No. 16158432.1, dated Jun. 30, 2016 (10 pages).

* cited by examiner

*Primary Examiner* — Bradley Thies

(74) *Attorney, Agent, or Firm* — Harness, Dickey & Pierce, P.L.C.

(57) ABSTRACT

Provided is a liquid storing body for preventing a liquid containing a sedimentous component with a predetermined concentration or more from being supplied to a liquid jetting apparatus. An ink tank is provided with an ink storing part in which an opening provided on a side surface of a case is sealed with a film. An ink injection port is formed in an upper portion wall of the case. A plug member is provided with a sealing part that can seal the ink injection port, an operation part that is inserted in an ink reservoir chamber via the ink injection port, and a stirring portion provided at the lower end of the operation part. Ink in the ink storing part can be stirred by a user moving the plug member up and down with their hand.

11 Claims, 5 Drawing Sheets

LIQUID STORING BODY INCLUDING A STIRRING MEMBER

BACKGROUND

1. Technical Field

The present invention relates to a liquid storing body for supplying a liquid containing a sedimentous component such as pigment to a liquid jetting apparatus.

2. Related Art

Inkjet printers (liquid jetting apparatus) that use pigment ink (liquid) are known. In pigment ink, pigment is dispersed as particles in a solvent, and therefore if an ink tank or an ink pack (liquid storing body) storing the pigment ink is left for a long period of time, the pigment settles in the ink tank or the ink pack. As a result, the concentration of the pigment in the ink tank or the ink pack varies depending on the height, leading to a nonuniform concentration state.

If the concentration is not uniform in the ink tank or the ink pack, there is a risk that high-concentration ink with a pigment concentration that is higher than in the uniform concentration state is supplied to the inkjet printer. If the high-concentration ink is supplied to the inkjet printer, print density is increased, and deterioration of image quality occurs, in some cases. In addition, because an increase in pigment concentration increases the viscosity of the pigment ink, if the high-concentration ink is supplied to the inkjet printer, clogging or the like easily occurs in the ink nozzle of the inkjet head.

In JP-A-2010-184424 and JP-A-2012-76422, inkjet printers provided with a means for stirring pigment ink in an ink tank or ink pack are disclosed. In the inkjet printer in JP-A-2010-184424, an ink tank provided with a plurality of ink containers (sub tanks) is fixed to a carriage to which a print head is mounted. Each of the ink containers has stirring balls therein, and the stirring balls move in the container along with the reciprocal movement of the carriage, thereby stirring the pigment ink in the container. In addition, in the inkjet printer of JP-A-2012-76422, electrodes are installed at positions at which they face each other with a main tank for storing pigment ink sandwiched therebetween. An electric field is generated between the electrodes by applying an alternating-current voltage to the electrodes, and the pigment ink undergoes convection due to the electrostatic attraction acting on the pigment particles, and is stirred.

JP-A-2010-184424 and JP-A-2012-76422 are examples of related art.

The configurations of JP-A-2010-184424 and JP-A-2012-76422 have a means for stirring pigment ink, but these configurations require a driving source and a power supply. Specifically, the configuration of JP-A-2010-184424 requires a driving source for reciprocally moving the carriage in order to stir the ink. In addition, the configuration of JP-A-2012-76422 requires electrodes and a power supply in order to stir the ink. Therefore, the configurations are complicated.

SUMMARY

An advantage of some aspects of the invention is to provide a liquid storing body that can eliminate sedimentation of a sedimentous component with a simple configuration.

In order to solve the above-described problem, a liquid storing body of an aspect of the invention includes: a liquid storing part that is capable of storing a liquid containing a sedimentous component; a liquid supply part that is capable of supplying the liquid from the liquid storing part to a liquid jetting apparatus; an opening portion provided at an upper portion of the liquid storing part; and a stirring member having an operation part that is inserted into the liquid storing part via the opening portion, and a stirring portion arranged in the liquid storing part.

According to this aspect of the invention, the stirring member is inserted in the opening portion of the liquid storing part, and therefore by a user appropriately moving this stirring member up and down using their hand, it is possible to stir the liquid with the stirring portion and generate a convection flow in the liquid storing part. Therefore, it is possible to eliminate or reduce the concentration difference of the liquid in the height direction with a simple structure. It is thus possible to avoid the deterioration of printing quality and ink nozzle clogging due to high-concentration ink being supplied to an inkjet head.

In another aspect of the invention, it is desirable that in the case where the liquid storing body further includes a plug member that is mountable to the opening portion, the operation part is supported by the plug member. Accordingly, the operation part can be supported in a stable manner by mounting the plug member to the opening portion. Here, "supported" includes both the state in which the operation part is attached or fixed to the plug member, and the state in which the operation part is supported so as to be able to move relative to the plug member. For example, a configuration is possible in which the plug member has a through hole that extends therein in a direction of a central axis of the plug member, and the operation part can slide along the through hole. With such a configuration, the stirring member can be moved up and down without attaching or detaching the plug member.

In addition, in order to solve the above-described problem, a liquid storing body of another aspect of the invention includes: a liquid storing part that is capable of storing a liquid containing a sedimentous component; a liquid supply part that is capable of supplying the liquid from the liquid storing part to a liquid jetting apparatus; an opening portion provided at an upper portion of the liquid storing part; and a plug member that is mountable to the opening portion, wherein the plug member includes a sealing part that can seal the opening portion, an operation part supported by the sealing part and inserted in the liquid storing part, and a stirring portion arranged in the liquid storing part.

According to this aspect of the invention, the plug member that is mounted to the opening portion of the liquid storing part is provided with the stirring portion and the operation part, and therefore the stirring portion can be appropriately moved up and down by the user moving the operation part with their hand, thereby stirring a liquid and generating a convection flow in the liquid storing part. Therefore, with a simple structure, it is possible to eliminate or reduce the concentration difference of the liquid in the height direction. Accordingly, it is possible to avoid the deterioration of printing quality and ink nozzle clogging due to high-concentration ink being supplied to the inkjet head.

In another aspect of the invention, it is desirable that the opening portion is an injection port for injecting the liquid into the liquid storing part. Accordingly, there is no need to provide an opening, besides the injection port, in which a member provided with the stirring portion and the operation part is arranged. Therefore, with a simple structure, it is possible to eliminate the concentration difference of the liquid in the height direction.

In this case, it is desirable that a flow path for guiding inflow of the liquid is provided on the operation part.

Accordingly, for liquid injection, it is possible to inject the liquid along the flow path of the operation part. Therefore, it is possible to reduce air bubble inflow that occurs during liquid injection.

In another aspect of the invention, it is desirable that a grasping part is provided at the upper end of the operation part. Accordingly, the user can hold the grasping part and move the operation part. Therefore, it is easy to move the operation part and stir the liquid.

In this case, it is desirable that a vertically stretchable elastic member is arranged so as to be able to abut on the grasping part between the grasping part and the opening portion. Accordingly, if the grasping part is moved in the stretching direction of the elastic member, the grasping part is biased toward the pre-movement position due to the elastic return force of the elastic member for returning to its reference size. Therefore, the operation part and the stirring portion can be easily moved up and down, making it easy to stir the liquid.

In addition, in this case, a configuration is possible in which the liquid storing body further includes: a case body that stores the liquid storing body; and a lid member attached to the case body in an openable and closable manner, wherein the lid member compresses the elastic member via the grasping part when the lid member is in a closed state. Accordingly, it is possible to move the operation part and the stirring portion up and down in conjunction with the opening/closing operations of the lid member, without pressing down the grasping part separately.

According to another aspect of the invention, it is desirable that the liquid storing body further includes: a restriction part that restricts the operation part from coming out of the opening portion. Accordingly, the operation part is prevented from coming out of the opening portion of the liquid storing part. Therefore, it is possible to prevent the member provided with the operation part and the stirring portion from being lost. In this case, the restriction part can be provided on the operation part. Alternatively, the restriction part can also be provided in the opening portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

An ink tank (liquid storing body), which is an embodiment of the invention, will be described below with reference to the drawings.

First Embodiment

Figure 1A:
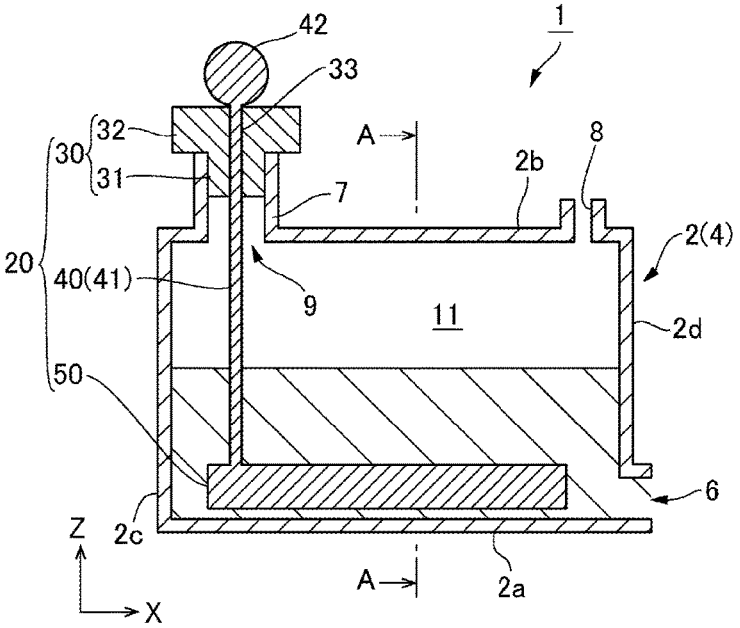
FIGS. 1A to 1C are explanatory views of an ink tank of a first embodiment to which the invention is applied.
Figure 1B:
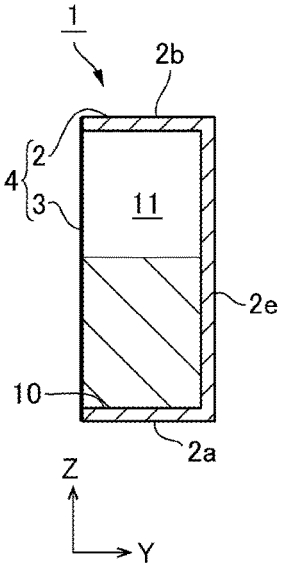
Figure 1C:
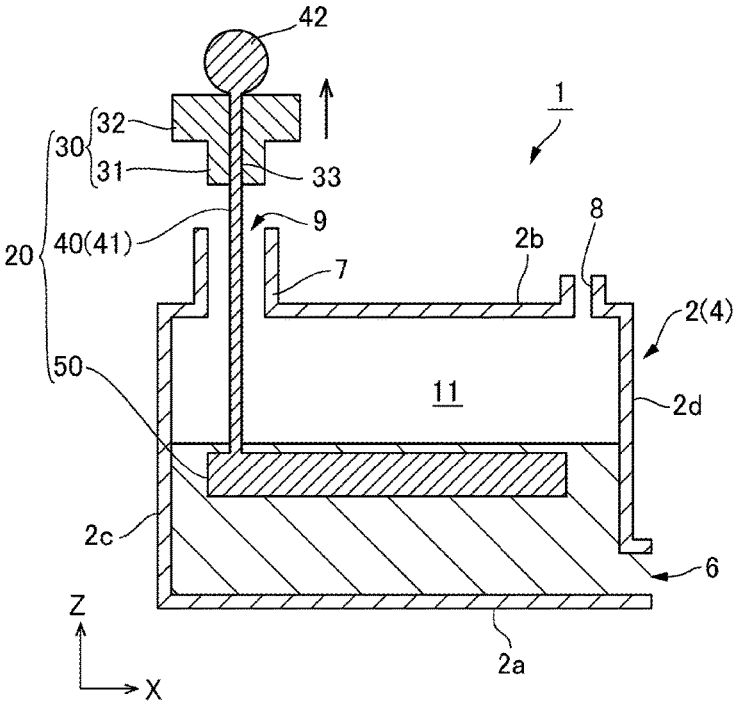

FIG. 1A is an explanatory view schematically showing an ink tank of a first embodiment to which the invention is applied, and FIG. 1B is a cross-sectional view of the ink tank taken along a cross sectional line A-A in FIG. 1A. In addition, FIG. 1C is an explanatory view showing the ink tank in the state in which a plug member is lifted. An ink tank 1 (liquid storing body) of the first embodiment is mounted to an inkjet printer (liquid jetting apparatus) provided with an inkjet head (print head), and supplies pigment ink to the inkjet head. Three directions X, Y and Z shown in FIG. 1 are directions that are orthogonal to one another, and the direction Z is the vertical direction. Regarding the three directions X, Y and Z, the direction of an arrow indicates the + direction (positive direction), and the direction opposite to the direction of the arrow indicates the − direction (negative direction). Moreover, a +Z direction indicates the upward side of the vertical direction, and a −Z direction indicates the downward side of the vertical direction.

The ink tank 1 is provided with an ink storing part 4 (liquid storing part) constituted by a resin case 2 and a flexible film 3 that seals an opening provided on a side of the case 2. In the case 2, an ink supply part 6 (liquid supply part) is formed to which an ink supply flow path (not illustrated) on the inkjet printer side is connected. As shown in FIG. 1A, the ink tank 1 is mounted to the inkjet printer in a posture in which the ink supply part 6 is positioned at a lower end of the case 2 in the vertical direction Z.

The case 2 has a substantially rectangular parallelepiped shape, and is provided with a bottom portion wall 2*a* that is the surface in the −Z direction, an upper portion wall 2*b* that is the surface in the +Z direction, a side wall 2*c* that is the surface in a −X direction, a side wall 2*d* that is the surface in a +X direction, and a side wall 2*e* that is the surface in a +Y direction. A cylindrical portion 7 and an atmospheric air communication part 8 that protrude in the +Z direction are formed in the upper portion wall 2*b* of the case 2. A through hole that passes through the cylindrical portion 7 is an ink injection port 9 (opening portion) that puts the interior and the exterior of the case 2 into communication. The cylindrical portion 7 is formed at the end of the upper portion wall 2*b* on the −X direction side. Note that the position of the cylindrical part 7 can be appropriately changed.

As shown in FIG. 1B, the case 2 is provided with a recess 10 that is surrounded by five surfaces, namely, the bottom portion wall 2*a*, the upper portion wall 2*b*, the side wall 2*c*, the side wall 2*d*, and the side wall 2*e*, and that is open in a −Y direction. The film 3 is formed of a synthetic resin (e.g., nylon, or polypropylene), and is joined to the edge of the recess 10 by a joining method such as welding. An ink reservoir chamber 11 surrounded by the case 2 and the film 3 is formed in the ink storing part 4. The ink reservoir chamber 11 is connected to the ink supply flow path on the inkjet printer side via the ink supply part 6 provided in the bottom portion of the case 2. Therefore, pigment ink in the ink reservoir chamber 11 can be supplied to the inkjet head through the ink supply flow path.

The ink tank 1 is provided with a plug member 20 that is mountable to the ink injection port 9. The plug member 20 is provided with a sealing part 30 capable of sealing the ink injection port 9, an operation part 40 that is inserted into the ink reservoir chamber 11 via the ink injection port 9, and a stirring portion 50 provided at the lower end of the operation part 40. The sealing part 30 is provided with a columnar small diameter portion 31 that is in contact with the interior of the cylindrical portion 7, and a large diameter portion 32 that is provided at the upper end of and coaxially with the small diameter portion 31. The sealing part 30 is provided with a through hole 33 extending in the direction of the central axis of the small diameter portion 31 and the large diameter portion 32. The operation part 40 is provided with an operation rod 41 extending linearly, and a grasping portion 42 formed at the upper end of the operation rod 41. The stirring portion 50 extends in a plate shape from the lower end of the operation rod 41 in a direction intersecting the operation rod 41. The stirring portion 50 may be formed integrally with the operation part 40, or may be obtained by fixing a member different from the operation part 40 to the operation part 40. The operation part 40 is assembled to the sealing part 30 such that the upper end portion of the operation rod 41 is inserted in the through hole 33, and the grasping portion 42 protrudes out from the upper end of the through hole 33 and is fixed to the sealing part 30. Therefore, the plug member 20 is an integral member as a whole.

The plug member 20 can be moved to a closed position at which the ink injection port 9 is sealed with the sealing part 30 (see FIG. 1A), and an open position at which the sealing part 30 is removed from the ink injection port 9 and is lifted up (see FIG. 1C). At the closed position, the small diameter portion 31 is in contact with the interior of the cylindrical portion 7, and the large diameter portion 32 abuts on the upper end of the cylindrical portion 7 from above. In this state, the operation rod 41 of the operation part 40 is supported by the sealing part 30 and extends in the vertical direction Z in the ink reservoir chamber 11. The stirring portion 50 is positioned near the bottom portion of the ink reservoir chamber 11, and extends substantially horizontally from the lower end of the operation rod 41 along the bottom portion wall 2*a*. At the open position, the operation rod 41 is lifted integrally with the sealing part 30, and thus the stirring portion 50 rises in the ink reservoir chamber 11 to a height that is in accordance with the rising amount of the sealing part 30.

Here, the concentration of the pigment ink that is supplied to the inkjet head has a proper range, and pigment ink stored in the ink reservoir chamber 11 has a pigment concentration that is within the proper range in the state in which there is no sedimentation of the pigment component. When a long period of time passes without printing being performed, the pigment component settles, leading to a state in which the concentration varies depending on the height in the ink reservoir chamber 11. As a result, a high-concentration ink layer in which ink with a pigment concentration that exceeds the proper range is accumulated is formed in the bottom portion of the ink reservoir chamber 11. At the closed position, the stirring portion 50 of the plug member 20 is positioned in the high-concentration ink layer. It is possible to hold the grasping portion 42 and move the plug member 20 up and down, and at this time, the stirring portion 50 moves up and down in the ink reservoir chamber 11. Accordingly, the ink in the ink reservoir chamber 11 is stirred, and a convection flow is generated between lower high-concentration ink and upper low-concentration ink. As a result, the high-concentration ink and the low-concentration ink are mixed, and the concentration difference of the ink depending on the height is eliminated or reduced.

In this manner, the ink tank 1 of the first embodiment makes it possible for the user to appropriately hold the grasping portion 42 with their hand and move the plug member 20 up and down, and cause the upper ink and the lower ink to undergo convection by moving the stirring portion 50 up and down in the ink reservoir chamber 11. Therefore, with a simple structure, it is possible to reliably eliminate or reduce the concentration difference of the ink due to the sedimentation of the pigment component. Accordingly, it is possible to avoid the deterioration of printing quality and ink nozzle clogging due to high-concentration ink being supplied to the inkjet head.

Variation 1

Figure 2:
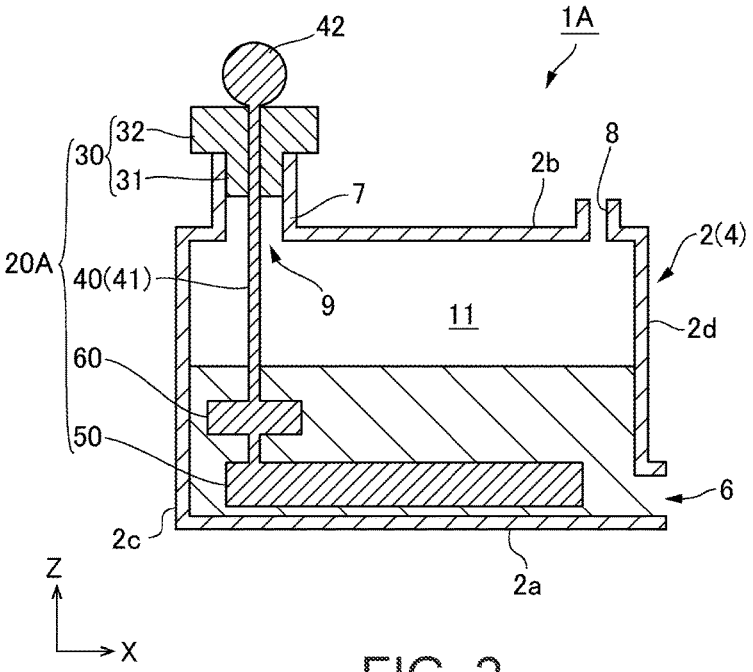
FIG. 2 is an explanatory view of an ink tank of Variation 1.

FIG. 2 is an explanatory view schematically showing an ink tank of Variation 1. The same reference signs are assigned to portions the same as in the first embodiment, thereby omitting description thereof, and different reference signs are assigned to only different portions and description thereof will be given below. An ink tank 1A (liquid storing body) of Variation 1 is provided with the ink storing part 4 (liquid storing part) constituted by the case 2 and the film 3, and a plug member 20A that is mountable to the ink injection port 9 formed on the cylindrical portion 7 protruding from the upper portion wall 2*b* of the case 2. The plug member 20A is provided with the sealing part 30 capable of sealing the ink injection port 9, the operation part 40 having the operation rod 41 that is fixed to the sealing part 30 and is inserted into the ink storing part 4 through the ink injection port 9, the stirring portion 50 provided at the lower end of the operation rod 41, and a restriction portion 60 provided on the operation rod 41 at a position between the stirring portion 50 and the sealing part 30.

It is sufficient that the restriction portion 60 has a shape that does not allow it to pass through the ink injection port 9, and can be formed to have a shape of a disk having a diameter larger than the internal diameter of the cylindrical portion 7, for example. The restriction portion 60 is formed at a position nearer to the stirring portion 50 than to the sealing part 30. The plug member 20A of Variation 1 can prevent the operation rod 41 and the stirring portion 50 from coming out of the ink injection port 9 because the restriction portion 60 functions as a retaining portion. Therefore, it is possible to prevent the plug member 20A from being lost. In addition, the restriction portion 60 is arranged at a position close to the lower end of the operation rod 41, and thus the stirring portion 50 can be lifted to the upper portion of the ink storing part 4. Therefore, it is possible to move the stirring portion 50 up and down a large amount, and thus avoid the situation in which the restriction portion 60 hinders the stirring of the ink.

Variation 2

Figure 3A:
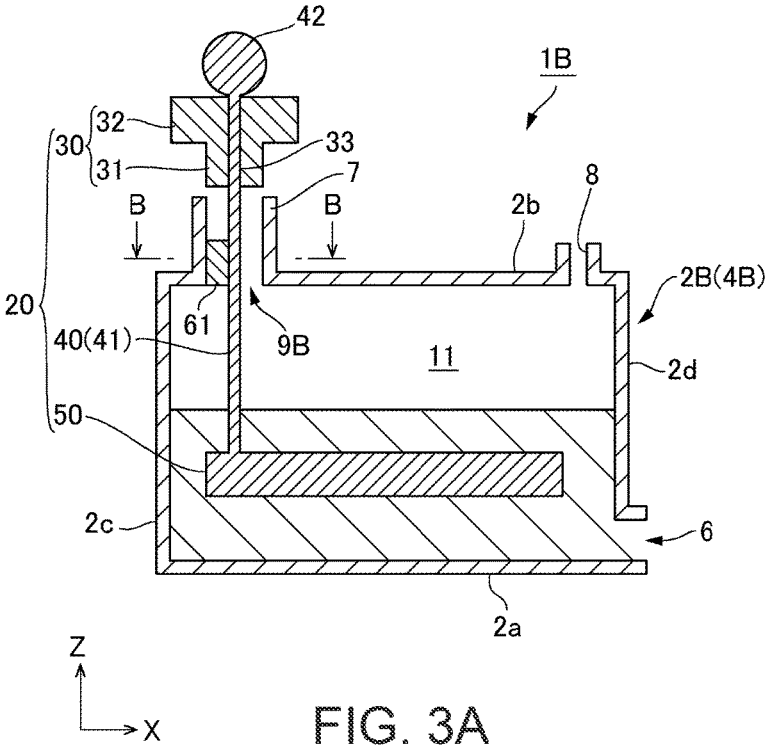
FIGS. 3A and 3B are explanatory views of an ink tank of Variation 2.
Figure 3B:
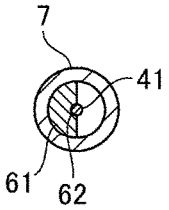

FIG. 3A is an explanatory view schematically showing an ink tank of Variation 2, and FIG. 3B is a partial cross-sectional view taken along a line B-B in FIG. 3A. The same reference signs are assigned to portions the same as in the first embodiment, thereby omitting description thereof, and different reference signs are assigned to only different portions and description thereof will be given below. An ink tank 1B (liquid storing body) of Variation 2 is provided with an ink storing part 4B (liquid storing part) constituted by a case 2B and the film 3, and the plug member 20 that is mountable to an ink injection port 9B formed in the upper portion wall 2*b* of the case 2B. The plug member 20 is provided with the sealing part 30 capable of sealing the ink injection port 9B, the operation part 40 having the operation rod 41 that is fixed to the sealing part 30 and is inserted into the ink reservoir chamber 11 via the ink injection port 9B, and the stirring portion 50 provided at the lower end of the operation rod 41.

In Variation 2, a restriction part 61 is fixed inside the ink injection port 9B formed in the cylindrical portion 7. The dimension of the cylindrical portion 7 in the vertical direction Z is greater than that of the small diameter portion 31, and the restriction part 61 is positioned below the small diameter portion 31 that is in contact with the interior of the upper portion of the cylindrical portion 7 when the upper portion of the ink injection port 9B is sealed with the sealing part 30. The restriction part 61 is a member that has a semicircular cross section and is in contact with the interior of the cylindrical portion 7, and is provided with a recess 62 obtained by cutting out a semicircular portion that overlaps, in the vertical direction Z, the through hole 33 formed in the sealing part 30 in the state in which the sealing part 30 seals the ink injection port 9B. The operation rod 41 is supported by coming in contact with the interior of the recess 62 when passing through the ink injection port 9B, and slides along the recess 62 when the plug member 20 moves up and down.

The restriction part 61 prevents the stirring portion 50 provided at the lower end of the operation rod 41 from coming out of the ink injection port 9B when the plug member 20 is lifted up. Therefore, it is possible to prevent the plug member 20 provided with the operation part 40 and the stirring portion 50 from being lost. In addition, when stirring the ink by moving the plug member 20 up and down, the restriction part 61 can support the operation rod 41, and thus the postures of the operation rod 41 and the stirring portion 50 can be stabilized. Note that the restriction part 61 may be formed integrally with the cylindrical portion 7, or a member different from the cylindrical portion 7 may be fixed inside the cylindrical portion 7 as in this example.

Variation 3

Figure 4A:
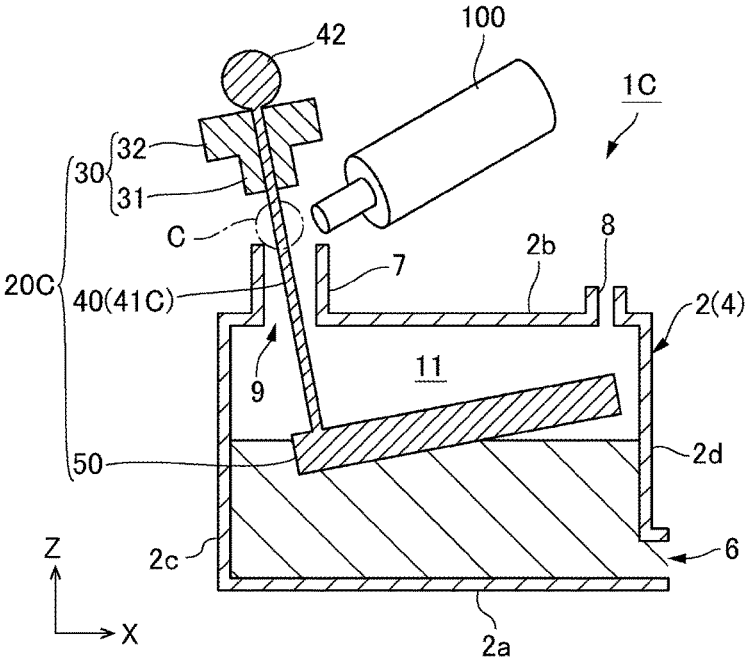
FIGS. 4A and 4B are explanatory views of an ink tank of Variation 3.
Figure 4B:
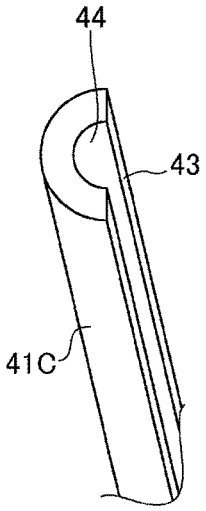

FIGS. 4A and 4B are explanatory views schematically showing an ink tank of Variation 3, where FIG. 4A is an explanatory view showing the state in which ink is being injected into the ink injection port 9, and FIG. 4B is a partial perspective view of an operation rod (an enlarged view of an area C in FIG. 4A). The same reference signs are assigned to portions the same as in the first embodiment, thereby omitting description thereof, and different reference signs are assigned to only different portions and description thereof will be given below. In an ink tank 1C of Variation 3, the ink injection port 9 is formed in the upper portion wall 2*b* of the case 2 constituting the ink storing part 4 (liquid storing part), and a plug member 20C is mounted to the ink injection port 9. The plug member 20C is provided with the sealing part 30, an operation rod 41C that is fixed to the sealing part 30 and is inserted into the ink storing part 4, the grasping portion 42 arranged at the upper end of the sealing part 30, and the stirring portion 50 provided at the lower end of the operation rod 41.

The operation rod 41C of Variation 3 has a semicircular cross section as shown in FIG. 4B, and the outer periphery thereof is provided with a flat surface 43 that faces the +X direction. A flow path groove 44 extending linearly over the entirety of the region from the upper end to the lower end of the operation rod 41C is formed in the flat surface 43. When injecting the ink into the ink injection port 9, the sealing part 30 is removed from the ink injection port 9, and the plug member 20C is lifted up, as shown in FIG. 4A. At this time, the operation rod 41C is in an inclined posture such that the flow path groove 44 faces obliquely upward. The ink to be injected from an ink bottle 100 into the ink injection port 9 is then injected onto the flow path groove 44.

In such a mode, the injected ink travels along the flow path groove 44 and reaches the liquid surface of the ink in the ink storing part 4, and therefore it is possible to reduce the inflow of air bubbles into the ink in the ink storing part 4 during the ink injection. Therefore, it is possible to avoid a defect due to air bubbles being mixed with the ink supplied to the inkjet head side through the ink supply part 6.

Second Embodiment

Figure 5:
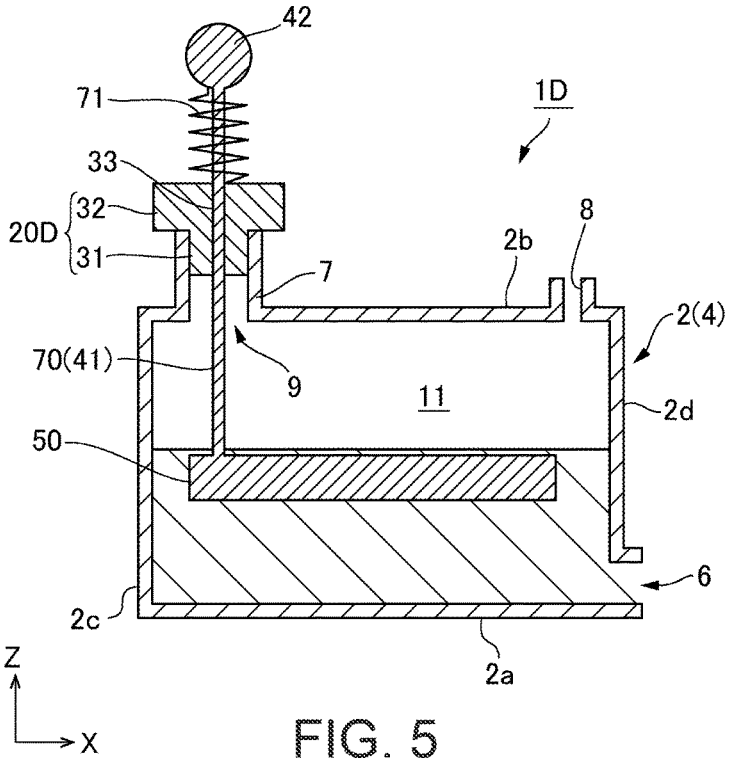
FIG. 5 is an explanatory view of an ink tank of a second embodiment to which the invention is applied.

FIG. 5 is an explanatory view schematically showing an ink tank of a second embodiment. The same reference signs are assigned to portions the same as in the first embodiment, thereby omitting description thereof, and different reference signs are assigned to only different portions and description thereof will be given below. An ink tank 1D (liquid storing body) of the second embodiment is provided with the ink storing part 4 (liquid storing part) constituted by the case 2 and the film 3, a plug member 20D that is mountable to the ink injection port 9 formed in the upper portion wall 2*b* of the case 2, a stirring member 70 supported by the plug member 20D, and an elastic member 71. The plug member 20D has the shape of only the sealing part 30 separated from the plug member 20 of the first embodiment, and is provided with the small diameter portion 31 and the large diameter portion 32 through which the through hole 33 is formed. The stirring member 70 has the shape of only the operation part 40 and the stirring portion 50 separated from the plug member 20 of the first embodiment, and is provided with the operation rod 41, the grasping portion 42 provided at the upper end of the operation rod 41, and the stirring portion 50 extending in a plate shape from the lower end of the operation rod 41.

In the second embodiment, the operation rod 41 is not fixed to the plug member 20D, and the operation rod 41 can slide along the through hole 33 of the plug member 20D. The elastic member 71 is a stretchable member such as a coil spring. The elastic member 71 is arranged along the upper end portion of the operation rod 41, and is arranged between the grasping portion 42 and the large diameter portion 32. It is sufficient that the elastic member 71 is a member that is mountable between the grasping portion 42 and the large diameter portion 32, and that generates elastic force in a direction of returning to the reference length when compressed or stretched, and, a member such as a sponge may be used.

The ink tank 1D of the second embodiment makes it possible to move the stirring member 70 up and down by sliding the operation rod 41 relative to the plug member 20D in the state in which the ink injection port 9 is sealed with the plug member 20D. Therefore, it is possible to stir the ink in the ink reservoir chamber 11 without removing the plug member 20D, while the ink injection port 9 is maintained in a sealed state. In addition, when sliding the operation rod 41 along the through hole 33, the elastic member 71 abuts on the grasping portion 42 and stretches, and thus the stirring member 70 is biased by the elastic force of the elastic member 71 via the grasping portion 42. Therefore, it is possible to cause the stirring member 70 to vibrate up and down due to the elastic force of the elastic member 71. Accordingly, the stirring of the ink using the stirring member 70 can be easily performed.

Note that in the second embodiment, the restriction portion 60 of Variation 1 may be provided on the operation rod 41. The restriction part 61 of Variation 2 may also be provided in the ink injection port 9. Accordingly, it is possible to prevent the plug member 20D and the stirring member 70 from being lost.

Third Embodiment

Figure 6:
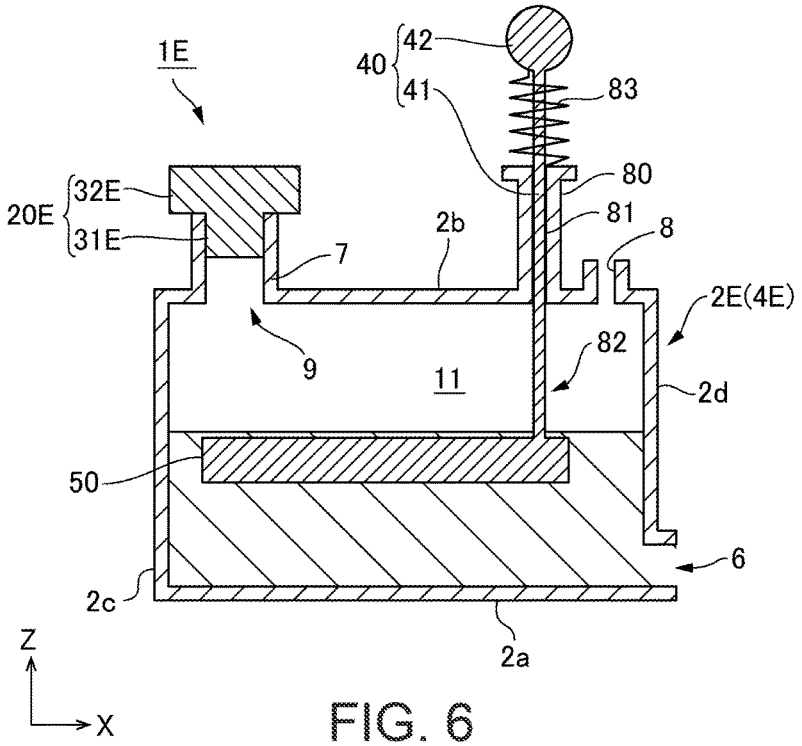
FIG. 6 is an explanatory view of an ink tank of a third embodiment to which the invention is applied.

FIG. 6 is an explanatory view schematically showing an ink tank of a third embodiment. The same reference signs are assigned to portions the same as in the above embodiments, thereby omitting description thereof, and different reference signs are assigned to only different portions and description thereof will be given below. An ink tank 1E (liquid storing body) of the third embodiment is provided with an ink storing part 4E (liquid storing part) constituted by a case 2E and the film 3. The ink storing part 4E is provided with the cylindrical portion 7 and a minor diameter cylindrical portion 80 that protrude in the +Z direction (upward) from the upper portion wall 2*b* of the case 2E, and the atmospheric air communication part 8. The ink injection port 9 is formed in the cylindrical portion 7. The ink storing part 4E is also provided with a through hole that passes through the minor diameter cylindrical portion 80, and this through hole is an opening portion 81 that puts the interior and the exterior of the case 2E into communication. The minor diameter cylindrical portion 80 and the atmospheric air communication part 8 are positioned at the end of the upper portion wall 2*b* on the +X direction side. Note that the positions of the cylindrical portion 7 and the minor diameter cylindrical portion 80 can be appropriately changed.

The ink tank 1E is provided with a plug member 20E that is mounted to the cylindrical portion 7 and seals the ink injection port 9. The plug member 20E is provided with a small diameter portion 31E that is in contact with the interior of the cylindrical portion 7, and a large diameter portion 32E that abuts on the upper end of the cylindrical portion 7. The ink tank 1E is also provided with a stirring member 82 that is inserted from the opening portion 81 of the minor diameter cylindrical portion 80 into the ink storing part 4E, and an elastic member 83. The stirring member 82 is provided with the operation part 40 provided with the operation rod 41 and the grasping portion 42, and the plate-shaped stirring portion 50 extending from the lower end of the operation rod 41 in a direction intersecting the operation rod 41 (the +X direction in FIG. 6). The operation rod 41 is in contact with the interior of the opening portion 81, and can slide up and down along the inner peripheral surface of the opening portion 81. The elastic member 83 is a member similar to the elastic member 71 of the second embodiment, and is mounted between the minor diameter cylindrical portion 80 and the grasping portion 42 along the upper end portion of the operation rod 41.

In the third embodiment, similarly to the first and second embodiments, a user can appropriately hold the grasping portion 42 with their hand and move the stirring member 82 up and down. Therefore, it is possible to cause the ink to undergo convection by moving the stirring portion 50 up and down in the ink reservoir chamber 11, and thereby eliminate or reduce the concentration difference of the ink depending on the height. Therefore, with a simple structure, it is possible to avoid the deterioration of printing quality and ink nozzle clogging due to high-concentration ink being supplied to the inkjet head. In particular, in the third embodiment, a configuration is adopted in which the stirring member 82 is inserted from the opening portion 81 that is different from the ink injection port 9, and thus it is possible to avoid the situation where the stirring member 82 hinders ink injection into the ink injection port 9. In addition, there is no need to attach/detach the plug member 20E for stirring the ink, and thus the stirring of the ink is easy. Furthermore, it is possible to cause the stirring member 82 to vibrate using the elastic force of the elastic member 83, and thus the stirring of the ink is easy. Note that the elastic member 83 may be omitted.

Fourth Embodiment

Figure 7A:
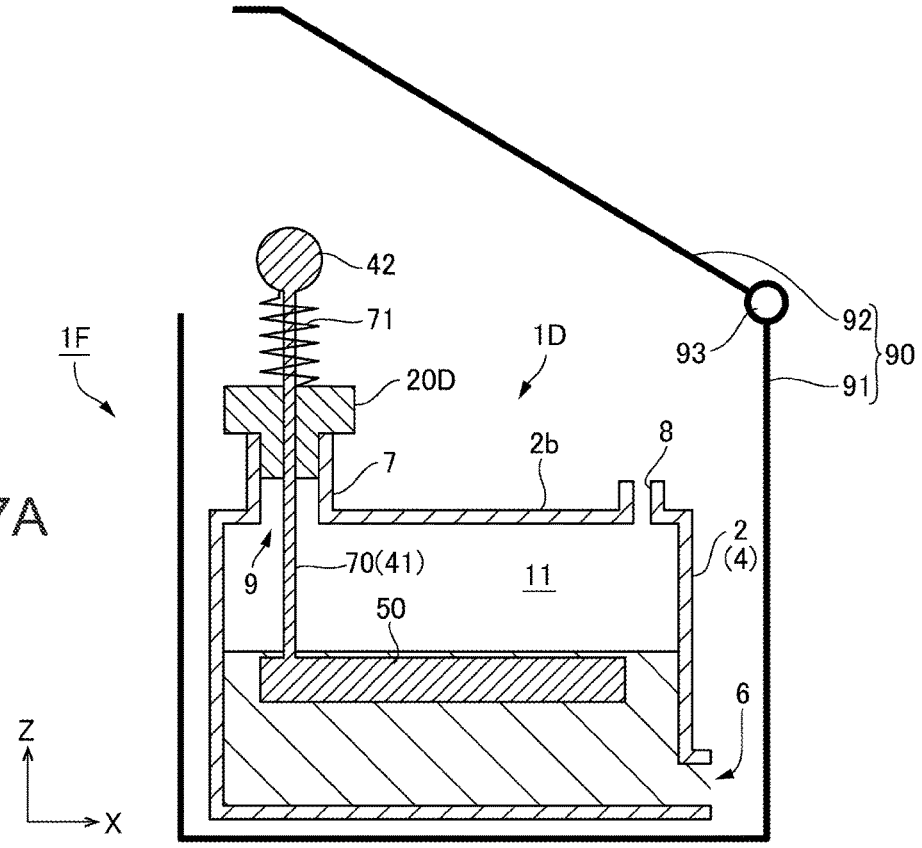
FIGS. 7A and 7B are explanatory views of an ink tank of a fourth embodiment to which the invention is applied.
Figure 7B:
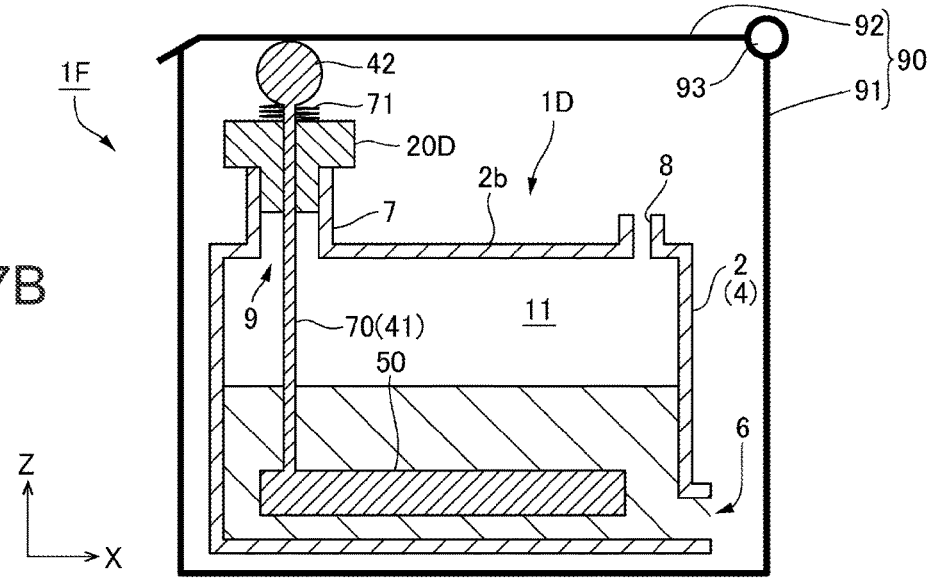

FIGS. 7A and 7B are explanatory views schematically showing an ink tank of a fourth embodiment, where FIG. 7A shows the state in which a lid member of an outer case is open, and FIG. 7B shows the state in which the lid member of the outer case is closed. The same reference signs are assigned to portions the same as in the above embodiments, thereby omitting description thereof, and different reference signs are assigned to only different portions and description thereof will be given below. An ink tank 1F (liquid storing body) of the fourth embodiment is the ink tank 1D of the second embodiment that is stored in an outer case 90. The outer case 90 is provided with a case body 91 that is open at the upper end, and a lid member 92 attached thereto so as to be able to open and close the opening of the case body 91. The lid member 92 is able to vertically open and close by pivoting centered on a shaft 93 provided at the opening edge of the case body 91 in the +X direction. The ink tank 1E is stored in the case body 91, such that the ink injection port 9 is arranged at the end of the upper portion wall 2*b* in the +X direction. The ink supply part 6 provided in the bottom portion of the ink tank 1F is connected to the ink supply flow path (not illustrated) that is inserted from outside into the case body 91.

In the ink tank 1F of the fourth embodiment, in the state in which the lid member 92 is closed (see FIG. 7B), the lid member 92 abuts on the grasping portion 42 provided at the upper end of the stirring member 70, and the stirring member 70 is being pressed down via the grasping portion 42. Therefore, in this state, the elastic member 71 is in a compressed state, and the stirring portion 50 is positioned near the bottom portion of the ink reservoir chamber 11. However, when the lid member 92 is opened, as shown in FIG. 7A, the grasping portion 42 rises due to the elastic force of the elastic member 71, the stirring member 70 moves upward, and therefore the stirring portion 50 rises from the bottom portion of the ink reservoir chamber 11. When the lid member 92 is closed again, the elastic member 71 is compressed again, and the stirring portion 50 is lowered to near the bottom portion of the ink reservoir chamber 11.

The ink tank 1F makes it possible to move the stirring member 70 up and down due to the opening/closing operations of the lid member 92 and the elastic force of the elastic member 71 in this manner. Therefore, the stirring member 70 can be moved up and down in conjunction with the opening/closing operations of the lid member 92, without pressing down the grasping portion 42 separately. In addition, in the state in which the lid member 92 is open, similarly to the above embodiments, it is also possible to move the stirring member 70 up and down by the user pressing it down with their hand, and thereby stir the ink.

Variations of First to Fourth Embodiments (1) The mode of the stirring portion 50 that stirs ink by moving up and down in the ink reservoir chamber is not limited to merely a plate shape, and another mode can be adopted. For example, a mode may be adopted in which a through hole is formed in the stirring portion 50, and a mode of a comb-like shape may be adopted. A mode may also be adopted in which a shaft body extending linearly, and a blade extending in a direction intersecting the shaft body are provided. A mode may also be adopted in which propeller-shaped blade members rotatably attached to a shaft body are provided.

(2) The configurations of Variations 1 to 3 (the restriction parts 60 and 61, and the flow path groove 44) may be applied to the second and fourth embodiments. In addition, in the fourth embodiment, the mode of the ink tank that is arranged in the outer case 90 may be the mode of the ink tank 1E of the third embodiment instead of the mode of the ink tank 1D of the second embodiment. In this case, it is desirable that the ink tank 1E is arranged such that the minor diameter cylindrical portion 80 is positioned below the free end of the lid member 92.

The entire disclosure of Japanese Patent Application No. 2015-043266, filed Mar. 5, 2015, is expressly incorporated by reference herein.

What is claimed is:

1. A liquid storing body comprising:

a liquid storing part that is capable of storing a liquid containing a sedimentous component;

a liquid supply part that is capable of supplying the liquid from the liquid storing part to a liquid jetting apparatus;

an opening portion provided at an upper portion of the liquid storing part;

a stirring member having an operation part and a stirring portion, wherein the operation part is inserted into the liquid storing part via the opening portion, and the stirring portion is arranged in the liquid storing part; and a plug member that is mountable to the opening portion, wherein the plug member has a through hole that extends therein in a direction of a central axis of the plug member, and the operation part can slide along the through hole.

2. The liquid storing body according to claim 1, wherein the operation part is supported by the plug member.

3. The liquid storing body according to claim 1, wherein the opening portion is an injection port for injecting the liquid into the liquid storing part.

4. The liquid storing body according to claim 3, wherein a flow path for guiding inflow of the liquid is provided on the operation part.

5. The liquid storing body according to claim 1, wherein a grasping part is provided at an upper end of the operation part.

6. The liquid storing body according to claim 5, wherein a vertically stretchable elastic member is arranged so as to be able to abut on the grasping part between the grasping part and the opening portion.

7. The liquid storing body according to claim 6, further comprising:

a case body that stores the liquid storing body; and a lid member attached to the case body in an openable and closable manner, wherein the lid member compresses the elastic member via the grasping part when the lid member is in a closed state.

8. The liquid storing body according to claim 1, further comprising:

a restriction part that restricts the operation part from coming out of the opening portion.

9. The liquid storing body according to claim 8, wherein the restriction part is provided on the operation part.

10. The liquid storing body according to claim 8, wherein the restriction part is provided in the opening portion.

11. A liquid storing body comprising:

a liquid storing part that is capable of storing a liquid containing a sedimentous component;

a liquid supply part that is capable of supplying the liquid from the liquid storing part to a liquid jetting apparatus;

an opening portion provided at an upper portion of the liquid storing part; and a plug member that is mountable to the opening portion, wherein the plug member includes a sealing part that can seal the opening portion, a stirring member having an operation part and a stirring portion, wherein the operation part is supported by the sealing part and inserted in the liquid storing part and the stirring portion is arranged in the liquid storing part, and a grasping part provided at an upper end of the operation part, wherein a vertically stretchable elastic member is arranged so as to be able to abut on the grasping part between the grasping part and the opening portion, and wherein the plug member compresses the elastic member via the grasping part when the plug member is in a closed state.

* * * * *